United States Patent [19]

Douthett et al.

[11] 4,295,769

[45] Oct. 20, 1981

[54] COPPER AND NITROGEN CONTAINING AUSTENITIC STAINLESS STEEL AND FASTENER

[75] Inventors: Joseph A. Douthett, Monroe; Ronald H. Espy, West Chester, both of Ohio

[73] Assignee: Armco Inc., Middletown, Ohio

[21] Appl. No.: 125,551

[22] Filed: Feb. 28, 1980

[51] Int. Cl.[3] ..... C22C 38/16; F16B 53/06

[52] U.S. Cl. ..... 411/411; 75/125; 75/128 A; 75/128 G; 75/128 N; 75/128 T; 138/177; 148/38; 148/39

[58] Field of Search ..... 75/125, 128 A, 128 P, 75/128 N, 128 G, 128 T; 148/38, 39; 411/378, 411; 138/177; 428/586, 595

[56] References Cited

U.S. PATENT DOCUMENTS 3,615,365 10/1971 McCunn ..... 75/125

3,615,366 10/1971 Allen ..... 75/125

*Primary Examiner*—Michael L. Lewis

*Attorney, Agent, or Firm*—Frost & Jacobs

[57] ABSTRACT

A low cost austenitic stainless steel having a high work hardening rate and good ductility if drastically cold reduced, consisting essentially of, in weight percent, 0.05% maximum carbon, 1.5% to 3.0% manganese, about 0.06% maximum phosphorus, about 0.035% maximum sulfur, about 1% maximum silicon, about 15% to about 20% chromium, 3% to 4.7% nickel, 1.75% to 3% copper, 0.10% to 0.30% nitrogen, up to about 0.3% columbium, titanium, tantalum or mixtures thereof, and balance essentially iron. The steel has particular utility in fabrication of cold headed fasteners.

8 Claims, No Drawings

COPPER AND NITROGEN CONTAINING AUSTENITIC STAINLESS STEEL AND FASTENER

BACKGROUND OF THE INVENTION

This invention relates to a low cost austenitic stainless steel having relatively low nickel and manganese levels with properties equal to or better than AISI Types 301 and 304. The steel of this invention exhibits good hot working properties, good weldability and can be fabricated into a variety of products from both the hot worked and cold worked conditions such as strip, tubing, bar and rod. It has particular utility in the production of cold headed fasteners from cold drawn wire.

The steel of the present invention possesses the further advantage of being precipitation hardenable in the cold worked condition, particularly when drastically cold reduced 60%, in which condition it exhibits a 0.2% offset yield strength of 165 to 182 ksi, an elongation in 5 cm of at least 10% and a Rockwell C hardness of 45–50.

AISI Type 301 has a nominal composition of 0.15% maximum carbon, 2.00% maximum manganese, 0.045% maximum phosphorus, 0.030% maximum sulfur, 1.00% maximum silicon, 16% to 18% chromium, 6% to 8% nickel and balance iron.

AISI Type 304 has a nominal composition of 0.08% maximum carbon, 2.00% maximum manganese, 0.045% maximum phosphorus, 0.030% maximum sulfur, 1.00% maximum silicon, 18% to 20% chromium, 8% to 12% nickel, and balance iron.

In contrast to this, the austentitic stainless steel of the present invention contains from about 1.5% to 3.0% manganese, 3% to 4.7% nickel, 1.75% to 3% copper, 0.10% to 0.30% nitrogen and up to about 0.3% columbium, titanium, tantalum, or mixtures thereof.

U.S. Pat. No. 3,357,868 to Tanczyn discloses a precipitation-hardenable stainless steel containing 0.05% maximum carbon, 15% maximum manganese, 2% maximum silicon, 10% to 25% chromium, 4% to 15% nickel, 0.25% maximum nitrogen, 1% to 5% copper, 0.3% to 4% columbium, 5% maximum molybdenum, and balance essentially iron.

U.S. Pat. No. 3,615,366 to Allen discloses a precipitation-hardenable stainless steel containing 0.15% maximum carbon, 3% to 10% manganese, 1% maximum silicon, 15% to 19% chromium, 3.5% to 6% nickel, 0.04% to 0.4% nitrogen, 0.5% to 4% copper, and balance essentially iron.

U.S. Pat. No. 3,284,250 to Yeo discloses a steel containing 0.03% to 0.12% carbon, 10% maximum manganese, 2% maximum silicon, 16% to 20% chromium, 3% to 12% nickel, 0.5% maximum nitrogen, 0.15% to 0.3% columbium, 3% maximum molybdenum, 0.5% maximum aluminum, and balance essentially iron. When hot rolled within the temperature range of above 1900° to about 2300° F. and cold rolled without the usual process anneal between hot rolling and cold rolling the resulting cold rolled product is alleged to exhibit a yield strength of at least 50 ksi in the annealed condition, an elongation of at least 50% and a very fine grain size.

British Pat. No. 995,068 discloses an austenitic stainless steel consisting of a trace to 0.12% carbon, 5% to 8.5% manganese, 2.0% maximum silicon, 15.0% to 17.5% chromium, 3.0% to 6.5% nickel, 0.75% to 2.5% copper, a trace to 0.10% nitrogen, and remainder iron, with the constituents being controlled so that the martensite-forming characteristic is less than 10% according to a formula and the delta-ferrite forming characteristic is less than 10% according to a formula. Copper is also controlled so that it does not exceed 3.85%–0.18%×% manganese. The steel is stated to have high austenite stability and a low work hardening rate, due to avoidance of transformation to martensite during cold working.

Other U.S. patents disclosing austenitic stainless steels containing copper and nitrogen include No. 3,071,460 to Tanczyn, No. 3,282,684 to Allen, No. 3,567,528 to Mohling, No. 2,797,993 to Tanczyn, No. 2,784,083 to Linnert and No. 4,022,586 to Espy.

Other background prior art of which applicants are aware includes U.S. Pat. Nos. 2,797,992; 2,871,118; 3,615,368; 2,784,125; 2,553,706; 3,753,693; 3,910,788; and 2,527,287.

Despite the great variety of austenitic stainless steels now known, including precipitation-hardenable stainless steels, applicants are not aware of an austenitic prior art steel containing less than 5% nickel which exhibits the combination of high strength and hardness and good ductility when drastically cold reduced, together with good corrosion resistance, good hot workability and avoidance of weld area cracking in fusion weldments.

It is a principal object of the present invention to provide an austenitic stainless steel having the above novel combination of properties.

It is a further object of the invention to provide an austenitic stainless steel of low cost having properties substantially equivalent to those of AISI Types 301 and 304.

According to the invention, there is provided an austentic stainless steel having good hot workability, a 0.2 offset yield strength of 165 to 182 ksi and an elongation in 5 cm of at least 10% if cold reduced 60%, the steel consisting essentially of, in weight percent, 0.05% maximum carbon, about 1.5% to about 3.0% manganese, about 0.06% maximum phosphorus, about 0.035% maximum sulfur, about 1% maximum silicon, about 15% to about 20% chromium, 3% to 4.7% nickel, about 1.75% to 3% copper, about 0.10% to about 0.30% nitrogen, up to about 0.3% columbium, titanium, tantalum, or mixtures thereof, and remainder essentially iron.

DETAILED DESCRIPTION

It has been found that a critical interrelation exists among the nickel, manganese, copper and nitrogen ranges which results in the novel combination of properties of the steel of the present invention. More specifically, it has been found that a relatively narrow nickel range of 3% to 4.7% is essential, along with manganese ranging from about 1.5% to 3.0%, copper from about 1.75% to 3% and nitrogen from about 0.10% to 0.30% in order to obtain an elongation in 5 cm of at least 10% and a 0.2% offset yield strength of about 165 to 182 ksi when the steel is cold reduced 60%.

Applicants are unable to provide a hypothesis for the critical interrelation among the proportioning of nickel to manganese, copper and nitrogen, but test data have established definitely that departure of any one of the above elements from the critical ranges results in loss of the desired ductility. In this connection, it is pointed out that an elongation in 5 cm of at least 10% in the 60% cold reduced condition is required for satisfactory cold heading operations. The steel of the present invention thus has particular utility in the fabrication of cold headed fasteners and offers the further advantage of permitting precipitation hardening to develop a high thread hardness while retaining a tough, softer fastener core. Moreover, partial transformation to martensite as a result of drastic cold reduction permits the use of magnetic handling equipment for the cold headed fasteners when used in automotive assembly lines and the like.

A preferred steel in accordance with the present invention consists essentially of, in weight percent, about 0.04% maximum carbon, about 1.7% to about 2.75% manganese, about 0.03% maximum phosphorus, about 0.025% maximum sulfur, about 0.03% to about 0.75% silicon, about 16% to about 19% chromium, about 3.4% to about 4.6% nickel, about 2.2% to about 2.7% copper, about 0.13% to about 0.20% nitrogen, about 0.10% to about 0.20% columbium, and balance essentially iron.

In many prior art austenitic stainless steels having a nickel content below about 5%, austenite stability is achieved by increasing the manganese content. Thus the manganese level is inversely proportional to the nickel level. In contrast to this, in the steel of the present invention manganese is maintained at a relatively low maximum of 3.0% and preferably about 2.75%, and copper and nitrogen are added as partial substitutes for manganese to function both as austenite formers and austenite stabilizers. It has been found that a high work hardening rate, comparable to that of AISI Type 301, is achieved in the steel of the present invention by maintaining an austenite stability factor ranging from about 30 to about 33 calculated from the formula $30\times\%C+\%Mn+\%Cr+\%Ni+\%Cu+30\times\%N$. Thus, while control of the austenite stability factor does not insure an elongation in 5 cm of at least 10% when cold reduced 60%, the austenite stability factor does insure high yield strength and hardness after such drastic cold reduction. An austenite stability factor within the range of about 30 to about 33 permits partial transformation to martensite when the steel is drastically cold reduced, which would not occur in a steel having a higher austenite stability factor, e.g. in the range of 34–36, unless manganese were present in amounts greater than about 6%.

Test data summarized below indicate that the percentage ranges of nickel, manganese, copper and nitrogen, and the interrelation among these elements is in every sense critical. To a lesser extent control of the carbon content and purposeful addition of columbium, titanium, tantalum, or mixtures thereof, are critical for optimum weldability, particularly avoidance of weld area cracking.

A nickel range of 3% to 4.7% has been found to be essential for good ductility in the drastically cold reduced condition.

A minimum of about 1.5% manganese is essential for austenite stability. A maximum of about 3.0% manganese must be observed for good castability, rollability and weldability. Manganese reduces the vapor pressure of copper during arc welding, and this copper vapor would condense on the cooler base strip adjacent the weld deposit. The pure liquid copper causes cracks to occur during cooling as a result of tensile shrinkage stress. A maximum of about 3% manganese has been found to avoid this problem.

A minimum of about 1.75% copper has also been found to be essential in association with the nickel, manganese and nitrogen ranges of the steel to function as an austenite stabilizer and to impart precipitation hardening capability to the steel when in the martensitic state after drastic cold working. A maximum of about 3.0% copper should be observed in order to avoid exceeding the limit of solubility of copper in the steel.

Nitrogen is essential within the range of about 0.10% to about 0.30% for its strong austenite forming potential and its effect in increasing the hardness and strength of the steel in the cold worked and precipitation hardened condition.

Carbon is controlled to a maximum of 0.05% and preferably to a maximum of 0.04% in order to insure good weldability. A purposeful addition of columbium, titanium and/or tantalum is also preferably made in order to avoid weld area cracking. A maximum of about 0.3% columbium, titanium or tantalum, or a sum total of 0.3% for mixtures thereof is adequate for this purpose at the carbon and nitrogen levels contemplated. Preferably between about 0.1% and about 0.20% columbium is added.

A series of alloys has been prepared and tested for yield strength and percent elongation in the cold reduced condition. The compositions of this series of alloys are set forth in Table I, while the properties thereof are set forth in Table II. Examples 1–4 are steels in accordance with the invention, while Examples 5–13 are similar alloys wherein variation in one or more of the manganese, nickel, copper or nitrogen contents has been found to result in unacceptably low ductility in the drastically cold reduced condition. For purposes of further comparison AISI Types 301 and 304 samples were prepared and tested under the same conditions.

All examples except No. 13 and Type 304 in Table I were laboratory melted heats. The laboratory melted alloys were cast as 2.5 cm by 7.6 cm ingots. and hot rolled from 1260° C. to a thickness of 2.54 mm. For the annealed samples reported in Table II the hot rolled samples were annealed, cold rolled to 1.27 mm thickness and final annealed for test purposes. For the 60% cold reduced condition reported in Table II the hot rolled samples were annealed, and cold reduced to 1.0 mm for test purposes.

The two commercially produced examples were also subjected to similar hot rolling, annealing and cold reduction conditions.

Examples 5–13 in Table I, none of which is a steel of the present invention, are listed in order of increasing nickel content. It will be noted from Table II that none of Examples 5–13 exhibited an elongation in 5 cm of at least 10% after 60% cold reduction, despite yield strengths which varied from 149 to 246 ksi.

The following observations will be apparent from a comparison of the compositions as set forth in Table I and the properties as set forth in Table II:

Examples 5 and 6 had manganese, nickel and copper contents outside the respective ranges of these elements in the steel of the present invention.

Example 7 departed from the ranges of the steel of the invention only with respect to the nickel content of 2.9%. Despite the close approach of the composition of Example 7 to that of the broad composition of the steel of the invention, the elongation of Example 7 was only 4% in 5 cm in the 60% cold reduced condition. The relatively high yield strength of 237 ksi is attributable to the relatively low austenite stability factor of 29.89.

Examples 8 and 9 contained high manganese and copper at or near the residual level. Despite a nickel range within that of the steel of the invention Examples 8 and 9 exhibited elongations of only 5% and 6%, respectively, in the 60% cold reduced condition.

Example 10 contained copper at or near the residual level, with manganese, chromium, nickel and nitrogen within the ranges of the steel of the present invention. Carbon was slightly above the maximum of 0.05% of the steel of the invention. Here again the elongation in the 60% cold reduced condition was only 5%, and this alloy exhibited a high rate of work hardening, despite a relatively low yield strength in the annealed condition.

Examples 11 and 12 contained 4.8% and 5.5% nickel, respectively, and in all other respects were within the ranges of the steel of the present invention.

Example 13 had nickel and carbon contents above and a nitrogen content below the ranges of these elements in the steel of the invention.

Types 301 and 304 exhibited elongation values of only 5% in the 60% cold reduced condition, despite yield strengths and an austenite stability factor within the desired ranges of each.

Examples 7 and 11, which had nickel contents respectively just below and just above the nickel range of the steel of the invention, are believed to prove the criticality of the broad nickel range of 3% to 4.7%, in combination with the above recited ranges of manganese, copper and nitrogen. Thus, even though Examples 7 and 11 fell within the required ranges of all the other elements except nickel, neither exhibited sufficient ductility to permit satisfactory fabrication into cold headed fasteners.

Several commercial heats have also been induction melted and hot rolled to rod for cold drawing to various sizes. It was found that optimum hot reduction was obtained with nickel contents within the range of about 4.0% to about 4.5%, along with somewhat more restricted ranges for the other essential elements. Accordingly, a more preferred steel in accordance with the invention, consists essentially of, in weight percent, about 0.03% maximum carbon, about 1.75% to about 2.5% manganese, about 0.03% maximum phosphorus, about 0.02% maximum sulfur, about 0.40% to about 0.70% silicon, about 17.5% to about 18.25% chromium, about 4.0% to about 4.5% nickel, about 2.25% to about 2.6% copper, about 0.14% to about 0.18% nitrogen, about 0.10% to about 0.13% columbium, and balance essentially iron. A more preferred austenite stability factor for such a steel ranges from about 31 to about 32.5. In commercial practice an austenite stability aim of about 32 is desirable to compensate for segregation in commercial size castings during manufacture.

A commercial heat containing 0.032% carbon, 2.31% manganese, 0.025% phosphorus, 0.006%, 0.55% silicon, 17.83% chromium, 4.34% nickel, 0.16% nitrogen, 2.32% copper, 0.11% columbium, and balance essentially iron, was cast into plate ingots and wire ingots. The plate ingots were successfully rolled to 2.54 mm hot bands, annealed and spiral welded into pipe for several experimental applications. Some hot rolled material of 2.54 mm thickness was then cold rolled to strip and fabricated into straight seam fusion welded tubing. The wire ingots were hot reduced to 6.35 mm diameter round rod and cold drawn into wire for cold headed fastener applications. The wire was successfully converted into cold headed fasteners.

A comparison of representative samples of the steel of the present invention with representative samples of Type 304 in a variety of corrosive environments has confirmed the following conclusions:

The steel of the present invention is about equal to Type 304 in boiling 33% by volume acetic acid and 1% by volume hydrochloric acid at 35° C. In 65% boiling nitric acid specimens of the steel of the invention in the cold rolled condition were inferior to specimens of Type 304 in the cold rolled condition. On the other hand, specimens of the steels which were mill annealed, then heat treated at 677° C. for one hour and air cooled exhibited an opposite result with the steel of the present invention being greatly superior to Type 304 in boiling 65% nitric acid. In 5% by volume sulfuric acid at 80° C. the steel of the present invention was inferior to Type 304. However, in 1% by volume sulfuric acid at 80° C. the steel of the present invention was superior to Type 304. In boiling 50% by volume phosphoric acid the steel of the present invention was somewhat superior to Type 304 while in 5% by volume formic acid at 80° C. the two steels were substantially equal.

It is therefore apparent from the above data that steels within the broad composition ranges of the present invention have great utility for fabrication into cold headed fasteners by reason of the relatively high ductility and work hardening rate when drastically cold reduced. Other product forms such as strip, tubing, bar, rod, and the like, may be fabricated from preferred and more preferred steels of the invention. Moreover, preferred and more preferred steels of the invention, in both hot reduced form and cold reduced form, can be welded by conventional techniques without exhibiting weld area cracking.

It is further evident that steels in accordance with the invention exhibit a work hardening rate comparable to that of AISI Type 301. Cold headability of steels of the invention is superior to that of Types 301 and 304 due to the substantially higher ductility of the steels of the invention. Moreover, the high hardness in the threads developed as a result of the high work hardening rate can be increased still further by a final heat treatment which results in precipitation hardening of the threads to an even higher level while retaining a tough, soft core. This additional increase resulting from precipitation hardening is not available when using Types 301 and 304.

TABLE I

| | Compositions - Weight Percent | | | | | |
|---|---|---|---|---|---|---|
| Example No. | C | Mn | Cr | Ni | Cu | N |
| 1* | 0.038 | 1.8 | 17.1 | 3.4 | 2.4 | 0.17 |
| 2* | 0.041 | 1.7 | 16.9 | 3.8 | 2.4 | 0.14 |
| 3* | 0.035 | 1.8 | 17.1 | 4.6 | 2.5 | 0.14 |
| 4* | 0.035 | 2.0 | 17.4 | 4.1 | 2.7 | 0.15 |
| 5 | 0.032 | 6.4 | 16.4 | 2.0 | 1.1 | 0.19 |
| 6 | 0.031 | 7.1 | 16.5 | 2.5 | 1.6 | 0.18 |
| 7 | 0.039 | 1.8 | 17.1 | 2.9 | 2.5 | 0.14 |
| 8 | 0.040 | 6.8 | 17.1 | 3.1 | 0.5 | 0.15 |
| 9 | 0.044 | 6.7 | 17.3 | 3.9 | 0.5 | 0.16 |
| 10 | 0.064 | 1.8 | 17.4 | 3.9 | 0.5 | 0.15 |
| 11 | 0.035 | 1.9 | 17.4 | 4.8 | 2.7 | 0.15 |
| 12 | 0.033 | 1.9 | 17.3 | 5.5 | 2.6 | 0.17 |
| 13 | 0.060 | 1.5 | 17.5 | 7.5 | 2.5 | 0.04 |
| Type 301 | 0.068 | 1.9 | 17.3 | 6.7 | 0.5 | 0.08 |
| Type 304 | 0.060 | 1.0 | 18.5 | 9.0 | — | 0.04 |

All examples contained <0.045% P, <0.03% S and <1.0% Si.
There were no purposeful additions of Cb, Ti or Ta.
*Steels of the invention

TABLE II

| Example No. | Properties: Hot Worked & Annealed 0.2% Y.S. (ksi) | Hot Worked & Annealed Elong. 5 cm. (%) | 60% Cold Reduced 0.2% Y.S. (ksi) | 60% Cold Reduced Elong. 5 cm. (%) | Austenite Stability Factor |
|---|---|---|---|---|---|
| 1* | 44 | 25 | 182 | 11 | 30.24 |
| 2* | 45 | 30 | 173 | 14 | 30.50 |
| 3* | 46 | 50 | 166 | 14 | 31.31 |
| 4* | 52 | 50 | 173 | 16 | 31.91 |
| 5 | 50 | 37 | 208 | 4 | 32.79 |
| 6 | 47 | 62 | 177 | 5 | 34.14 |
| 7 | 64 | 14 | 237 | 4 | 29.89 |
| 8 | 49 | 60 | 210 | 5 | 33.45 |
| 9 | 51 | 62 | 187 | 6 | 34.81 |
| 10 | 47 | 37 | 246 | 5 | 30.26 |
| 11 | 52 | 59 | 166 | 7 | 32.49 |
| 12 | 54 | 51 | 167 | 6 | 33.65 |
| 13 | 35 | 55 | 149 | 4 | 32.00 |
| Type 301 | 39 | 63 | 187 | 5 | 30.99 |
| Type 304 | 37 | 58 | 174 | 5 | 31.50 |

*Steels of the invention

We claim:

1. Austenitic stainless steel having good hot working properties, a 0.2% offset yield strength of 165 to 182 ksi and an elongation in 5 cm of at least 10% if cold reduced 60%, said steel consisting essentially of, in weight percent, 0.05% maximum carbon, 1.5% to 3.0% manganese, about 0.06% maximum phosphorus, about 0.035% maximum sulfur, about 1% maximum silicon, about 15% to about 20% chromium, 3% to 4.7% nickel, 1.75% to 3% copper, 0.10% to 0.30% nitrogen, up to about 0.3% columbium, titanium, tantalum or mixtures thereof, and balance essentially iron, said steel having an austenite stability factor ranging between about 30 and about 33 calculated by the formula $30\times\%C+\%Mn+\%Cr+\%Ni+\%Cu+30\times\%N$.

2. The steel claimed in claim 1, consisting essentially of about 0.04% maximum carbon, about 1.7% to about 2.75% manganese, about 0.03% maximum phosphorus, about 0.025% maximum sulfur, about 0.30% to about 0.75% silicon, about 16% to about 19% chromium, about 3.4% to about 4.6% nickel, about 2.2% to about 2.7% copper, about 0.13% to about 0.20% nitrogen, about 0.1% to about 0.20% columbium, and balance essentially iron.

3. The steel claimed in claim 1, consisting essentially of about 0.03% maximum carbon, about 1.75% to about 2.5% manganese, about 0.03% maximum phosphorus, about 0.02% maximum sulfur, about 0.40% to about 0.70% silicon, about 17.5% to about 18.25% chromium, about 4.0% to about 4.5% nickel, about 2.25% to about 2.6% copper, about 0.14% to about 0.18% nitrogen, about 0.10% to about 0.13% columbium, and balance essentially iron, said steel having an austenite stability factor ranging between about 31 and about 32.5 calculated by the formula $30\times\%C+\%Mn+\%Cr+\%Ni+\%Cu+30\times\%N$.

4. The steel claimed in claim 1 in the form of cold headed fasteners fabricated from 60% cold reduced wire.

5. The steel claimed in claim 2 in the form of cold headed fasteners fabricated from 60% cold reduced wire.

6. The steel claimed in claim 2 in the form of strip, tubing, bar and rod.

7. The steel claimed in claim 3 in the form of hot reduced strip, bar and rod capable of at least 10% elongation in 5 cm and a 0.2% offset yield strength of 165 to 182 ksi if cold reduced 60%.

8. Austenitic stainless steel having good hot working properties, a 0.2% offset yield strength of 165 to 182 ksi and an elongation in 5 cm of at least 10% if cold reduced 60%, said steel consisting essentially of, in weight percent, about 0.04% maximum carbon, about 1.7% to about 2.75% manganese, about 0.03% maximum phosphorus, about 0.025% maximum sulfur, about 0.30% to about 0.75% silicon, about 16% to about 19% chromium, about 3.4% to about 4.6% nickel, about 2.2% to about 2.7% copper, about 0.13% to about 0.20% nitrogen, up to about 0.3% columbium, titanium, tantalum or mixtures thereof, and balance essentially iron, said steel having an austenite stability factor ranging between about 30 and about 33 calculated by the formula $30\times\%C+\%Mn+\%Cr+\%Ni+\%Cu+30\times\%N$.

* * * * *